United States Patent [19]

Manzonelli et al.

[11] 3,960,607

[45] June 1, 1976

[54] NOVEL ALUMINUM ALLOY, CONTINUOUSLY CAST ALUMINUM ALLOY SHAPES, METHOD OF PREPARING SEMIRIGID CONTAINER STOCK THEREFROM, AND CONTAINER STOCK THUS PREPARED

[75] Inventors: Carmen C. Manzonelli, Weirton, W. Va.; Robert G. Blossey, Coraopolis, Pa.

[73] Assignee: National Steel Corporation, Pittsburgh, Pa.

[22] Filed: Mar. 8, 1974

[21] Appl. No.: 449,392

[52] U.S. Cl. ..... 148/2; 75/141; 75/142; 148/11.5 A; 148/32

[51] Int. Cl.[2] ..... C22F 1/04

[58] Field of Search ..... 148/2, 11.5 A, 32, 32.5; 75/141, 142

[56] References Cited

UNITED STATES PATENTS

| | | | |
|---|---|---|---|
| 3,490,955 | 1/1970 | Winter et al. | 148/11.5 A |
| 3,802,931 | 4/1974 | Bylund | 148/11.5 A |

*Primary Examiner*—R. Dean

*Attorney, Agent, or Firm*—Shanley, O'Neil and Baker

[57] ABSTRACT

Continuously cast aluminum alloy castings are provided which may be cold worked to thin gages without the need for a homogenizing thermal treatment. The castings comprise an aluminum alloy which consists essentially of 0.30–0.50% of copper, 0.35–0.60% of magnesium, up to 0.50% of zinc, residual silicon in an amount up to 0.40%, residual iron in an amount up to 0.70%, residual manganese in an amount up to 0.10%, residual chromium in an amount up to 0.10%, residual sodium in an amount up to 0.0006%, other residual elements in a total amount up to 0.15% and in an amount up to 0.05% for each, and the remainder aluminum. The castings are preferably in the form of continuously cast strip having an initial thickness not greater than about one inch. The strip may be cold rolled in a plurality of cold rolling passes to a final thickness of about 0.001–0.01 inch in the absence of a homogenizing thermal treatment. The strip is annealed at least once intermediate the first and last cold rolling passes at an annealing temperature of 600–800°F. for a period of 1–6 hours. Following the last cold rolling pass, if desired the strip may be given a further anneal at a temperature of about 350–800°F. for about 0.5–10 hours. The resulting semirigid container stock is especially useful in the manufacture of disposable containers.

34 Claims, No Drawings

NOVEL ALUMINUM ALLOY, CONTINUOUSLY CAST ALUMINUM ALLOY SHAPES, METHOD OF PREPARING SEMIRIGID CONTAINER STOCK THEREFROM, AND CONTAINER STOCK THUS PREPARED

BACKGROUND OF THE INVENTION

The present invention broadly relates to a novel aluminum alloy and novel continuously cast aluminum alloy casting thereof which may be cold worked to thin gauges without requiring a homogenizing thermal treatment. The invention further relates to a novel method of preparing semirigid container stock from the continuously cast aluminum alloy castings of the invention and to the novel container stock thus prepared.

Aluminum alloy semirigid container stock is widely used in the manufacture of disposable containers such as dishes, trays, pans, and cup-like articles for prepared fresh or frozen foods. The containers are usually manufactured with modern high speed equipment which stamps blanks from the container stock in sheet or strip form, and thereafter the blanks are shaped to a desired configuration in a hydraulic press.

Aluminum alloy container stock for the manufacture of semirigid disposable containers should have a combination of desirable properties if entirely satisfactory results are to be achieved. The thickness of the thin gauge aluminum sheet or strip should be about 0.001–0.01 inch and preferably about 0.002–0.008 inch to conserve metallic aluminum and thereby reduce material costs. At such thin gauges, it is essential that the container stock have relatively high tensile and yield strength so that the semirigid containers prepared therefrom will be sufficiently strong. The container stock also must be ductile and readily formable so that the blanks may be easily shaped in the hydraulic press.

The aluminum alloy most commonly used heretofore in preparing semirigid container stock meets the specifications of American Society for Metals (ASM) aluminum alloy specification 3003. This alloy contains 1.2% nominal manganese and the remainder aluminum, and it must be continuously or semi-continuously direct chill cast into an ingot having a thickness of several inches or more which is hot rolled and then cold rolled to the final thickness of about 0.001–0.01 inch. It is also essential that such alloy be subjected to a homogenizing thermal treatment at a minimum temperature of 850°F. and usually at about 900°–1000°F. to control the undesirable effects of manganese, iron and/or silicon intermetallics. Because of the required hot rolling, the homogenizing thermal treatment must be conducted in a nonoxidizing atmosphere over a period of several hours and it adds very substantially to the cost of the product. Commercial operations employ the hot rolling step and the homogenizing thermal treatment and their elimination is not economically feasible.

In view of the foregoing, it is apparent that the prior art method of preparing semirigid container stock from aluminum alloy specification ASM 3003 requires an expensive hot rolling mill and a homogenizing thermal treatment which greatly increase the overall cost of the product. These costs could be reduced substantially by providing an aluminum alloy having the necessary properties for semirigid container stock capable of being cold rolled to a thickness of 0.001–0.01 inch without a homogenizing thermal treatment. The costs could be further reduced substantially by providing an aluminum alloy having the necessary properties for semirigid container stock which may be cast on a continuous strip caster to produce a ⅛ inch to 1 inch thick strip capable of being cold rolled to a thickness of 0.001 to 0.01 inch without a homogenizing thermal treatment to thus eliminate the requirement for a hot rolling mill and also the need for the costly prior art homogenizing thermal treatment.

Attempts have been made heretofore to continuously cast aluminum alloy specification ASM 3003 but it was not practical to homogenize the resulting continuously cast strip. Thus, the continuously cast strip could not be cold rolled to produce semirigid container stock having satisfactory properties. As a result, there has been a long standing need in this art for an aluminum alloy that may be continuously cast to provide castings which may be cold worked to thin gauges without requiring a homogenizing thermal treatment.

It is an object of the present invention to provide a novel aluminum alloy that may be continuously cast and cold worked to thin gauges without requiring a homogenizing thermal treatment.

It is a further object of the present invention to provide novel continuously cast aluminum alloy castings which may be cold worked to thin gauges without requiring a homogenizing thermal treatment.

It is a further object to provide novel continuously cast aluminum alloy castings that may be cold rolled without prior hot rolling and, in the absence of a homogenizing thermal treatment, to produce semirigid container stock having a thickness of about 0.001–0.01 inch.

It is a further object to provide a novel continuously cast aluminum alloy strip having a thickness not greater than about one inch which may be cold rolled in the absence of a homogenizing thermal treatment to produce semirigid container stock having a thickness of about 0.001–0.01 inch.

It is a further object to provide a method of preparing aluminum alloy semirigid container stock from the aforementioned continuously cast strip by cold rolling to the desired final thickness in the absence of a homogenizing thermal treatment.

It is a further object to provide the aluminum alloy semirigid container stock prepared by the aforementioned method of the invention.

Still other objects and advantages of the invention will be apparent to those skilled in the art upon reference to the following detailed description and the specific examples.

DETAILED DESCRIPTION OF THE INVENTION INCLUDING PREFERRED VARIANTS THEREOF

The aluminum alloy and the continuously cast aluminum alloy castings of the present invention consist essentially of 0.30–0.50% of copper, 0.35–0.60% of magnesium, up to 0.50% of zinc, residual silicon in an amount up to 0.40%, residual iron in an amount up to 0.70%, residual manganese in an amount up to 0.10%, residual chromium in an amount up to 0.10%, residual sodium in an amount up to 0.0006%, other residual elements in a total amount up to 0.15% and in an amount up to 0.05% for each, and the remainder aluminum. As in the case of aluminum-magnesium alloys, generally the residual sodium should not exceed 0.0006%. In instances where a brighter and/or more easily anodizable surface is of importance, the combined residual silicon and iron should be no greater than 0.45%; however, preferably the residual silicon and iron are each present in an amount up to 0.10%. A grain refiner may be present in an amount sufficient to refine the grain of the cold worked product. For example, about 0.001–0.01% of titanium or titanium-boron alloys may be present as a grain refiner, and preferably about 0.005–0.01%.

In one preferred variant of the invention, the zinc content of the foregoing aluminum alloy and aluminum alloy castings is residual in nature and the residual zinc is present in an amount up to 0.20%. The resulting alloy is usually preferred when a semirigid container stock is prepared for most commercial applications. The residual silicon and iron also should be present in an amount up to 0.10% of each in instances where a brighter surface and/or a more easily anodizable surface is of importance. Boron and/or titanium in an amount of 0.001–0.01% may be present as a grain refiner.

In a further preferred variant of the invention, the foregoing aluminum alloy and aluminum alloy castings contain copper in an amount of 0.30–0.40%, magnesium in an amount of 0.40–0.55% and zinc in an amount of 0.30–0.50%. Residual silicon and iron also should be present in an amount up to 0.10% in instances where a brighter surface and/or a more easily anodizable surface is of importance. Boron and/or titanium in an amount of 0.001–0.01% may be present as a grain refiner.

The continuously cast aluminum alloy castings are preferably in the form of strip having a thickness not greater than about 1 inch and are usually about ⅛–1 inch in thickness. For better results, the strip may have a thickness of approximately 0.2–0.3 inch. In most instances, a strip thickness of about 0.25 inch gives the best results when the strip is to be cold rolled in a plurality of cold rolling passes to produce semirigid container stock.

The continuously cast aluminum alloy castings may have configurations other than strip when desired. For example, the castings may be round or rod-like, substantially square or bar-like, or irregular in cross section. However, strip configurations are usually preferred especially in instances where the casting is to be cold worked to thin gauges of 0.01 inch or less by cold rolling. While cold rolling is usually the preferred method of cold working, it is understood that other suitable methods of cold working to thin gauges may be used including hammering, forging, hydraulic shaping, extrusion and the like.

The aluminum alloy semirigid container stock of the invention is preferably prepared by cold rolling a continuously cast aluminum alloy strip having the aforementioned composition. The strip has an initial thickness not greater than about 1 inch, and it is cold rolled in a plurality of cold rolling passes including first and last cold rolling passes to a final thickness of about 0.001–0.01 inch. The strip is cold rolled to the final thickness in the absence of a homogenizing thermal treatment, and it is subjected to at least one anneal under the conditions defined hereinafter intermediate the first and last cold rolling passes. The strip may or may not be given an anneal following the last cold rolling pass to arrive at the desired final temper, which may vary from full hard to fully annealed. The resulting container stock has properties which closely approximate the properties of semirigid container stock prepared from direct chill cast aluminum alloy specification ASM 3003. The semirigid container stock produced in accordance with the invention is as satisfactory for preparing semirigid containers as that produced heretofore from ASM aluminum alloy specification 3003.

The method of the invention allows semirigid container stock to be prepared from continuously cast aluminum alloy strip and thereby eliminate the prior art requirements for a hot rolling mill and/or a homogenizing heat treatment. In practicing the method, an aluminum alloy is prepared having the composition set forth hereinbefore following prior art practices. For instance, the alloy may be prepared from commercially pure molten aluminum (about 99.9% Al) to which aluminum scrap and alloying metals and/or master alloys are added to arrive at the desired final composition. As is well known in this art, commercially pure molten aluminum usually contains small amounts of iron, silicon, and other residual elements, and especially in instances where scrap aluminum has been added thereto. The specification ranges for copper, magnesium and zinc may be obtained by adding the desired metals or master alloys thereto after the scrap addition has been made and an analysis has been made to determine the exact composition of the molten metal. For example, the copper specification may be met by adding a master alloy containing 80% aluminum and 20% copper, the magnesium specification may be met by adding pig magnesium, and the zinc specification may be met by adding a master alloy of aluminum and zinc. The remaining major constituents are residual in nature, and thus an addition is not normally made of silicon, iron, manganese, chromium, sodium and other residual elements. In instances where titanium and/or titanium-boron alloys are added as a grain refiner, this may be done by adding master alloys containing aluminum and titanium and/or titanium-boron alloys. As noted above, the residual sodium should be maintained at a maximum of 0.0006% for otherwise cracks or other imperfections may appear when the continuously cast strip is cold rolled to thin gauges. To establish acceptable residual sodium content, the molten aluminum alloy having the defined composition with the exception of the sodium content is fluxed with a mixture of gaseous nitrogen and chlorine and then filtered to remove excess sodium that is present above the specification limits. Any excess hydrogen is also removed during this treatment. Preferably, following fluxing and filtering to remove solids such as oxides, the molten alloy has a sodium content less than 0.0006% and a hydrogen content not greater than 25 milliliters of hydrogen per 100 grams of molten metal. The resulting molten aluminum alloy meets all specifications and is ready to be continuously cast to produce a solidified aluminum alloy strip having a thickness not greater than about 1 inch.

A number of continuous strip casters may be used to cast the aluminum alloy strip. Examples of well known continuous strip casters include the Hazelett caster which is capable of casting a strip having a thickness of about 0.8–1.0 inch, the Crown Porterfield caster which is capable of continuously casting strip having a thickness of approximately 0.4–0.6 inch, the Harvey caster which is capable of continuously casting strip having a thickness of 0.2–0.3 inch, and the Hunter caster which is capable of continuously casting strip having a thickness of approximately 0.2–0.3 inch. The molten aluminum alloy described above may be continuously cast on the aforementioned casters following prior art practices. It is understood that the thickness of the strip may be varied somewhat by changing the operating variables. Thus, aluminum alloy strip having a thickness varying from approximately ⅛ inch to approximately 1 inch may be produced by selecting either the Harvey caster or the Hunter for relatively thin strip within this range, the Crown Porterfield caster for strip of intermediate thickness, and the Hazelett caster for strip in the vicinity of the maximum thickness of the range. As a general rule, the Hunter caster is presently preferred for casting aluminum alloy strip to be cold rolled to semirigid container stock gauges of 0.001–0.01 inch. It is also preferred that the strip thickness be about 0.2–0.3 inch and, for best results, approximately 0.25 inch, as then only one intermediate anneal is needed to arrive at the desired final thickness of 0.001–0.01 inch. Of course, a preliminary hot rolling step is not needed for strip having a thickness of 1 inch or less, and it has been discovered that a homogenizing thermal treatment is not required when using the aluminum alloy composition defined herein.

The as-cast strip is cold rolled in a plurality of passes until the desired thickness of 0.001–0.01 inch is reached. Prior art cold rolling practices may be employed. The number of cold rolling passes will depend somewhat upon the initial thickness of the strip and the final thickness that is desired in the product. As a general rule, the strip thickness is reduced by approximately 40–60% in each pass and preferably about 50%, and cold rolling is continued until the desired thickness is reached. At least one intermediate anneal is performed sometime after the first cold rolling pass and before the last cold rolling pass, and more than one intermediate anneal may be needed in some instances. Usually the intermediate anneal follows the second, third or fourth cold rolling pass in the series. At least one additional cold rolling pass is performed after the intermediate anneal, or as many cold rolling passes as are necessary to arrive at the desired final thickness. The intermediate anneal may be performed following prior art practices in an inert atmosphere at a temperature of about 600°–800°F. and over a period of approximately 1–6 hours. Preferably the intermediate annealing temperature is about 750°F. for about 3 hours. In instances where more than one intermediate anneal is performed, usually 2, 3 or 4 cold rolling passes are performed between the plurality of intermediate anneals.

After cold rolling to final gauge, the full hard semirigid container stock product may be allowed to remain in the full hard condition (H 18 Temper), or it may be fully annealed (O-temper), or it may be given any intermediate heat treatment between full hard and fully annealed to thereby arrive at the desired temper and physical properties. In instances where an annealing step is performed, it may be in accordance with prior art practice in an inert atmosphere and at a temperature of approximately 350°–800°F. for about 0.5–10 hours dependent upon the properties desired. As is well understood in this art, higher annealing temperatures and annealing for longer periods of time results in a softer product characterized by a lower temper number and lower physicals. The time and temperature conditions of the anneal may be selected in accordance with prior art practice to arrive at the physical properties desired in a specific instance.

The semirigid container stock thus prepared may be easily processed in accordance with the prior art practice employed for ASM 3003 aluminum alloy semirigid container stocks. For instance, blanks may be stamped therefrom which may be shaped in a hydraulic press to form the desired semirigid container. Examples of semirigid containers which may be formed in this manner are disposable dishes, trays, pans, and cup-like articles for prepared fresh or frozen foods. When used for such purposes, the semirigid container stock thus prepared is as satisfactory as semirigid container stock produced from ASM aluminum alloy specification 3003 and may be produced at much lower costs than when employing ASM aluminum alloy specification 3003 as there is no need for a hot rolling mill nor a homogenizing thermal treatment.

The foregoing detailed description and the following specific examples are for purposes of illustration only, and are not intended as being limiting to the spirit or scope of the appended claims.

EXAMPLE I

This example illustrates the method of the invention for preparing semirigid container stock without the need for a hot rolling mill nor a homogenizing thermal treatment.

A molten aluminum alloy is prepared containing 0.37% copper, 0.51% magnesium, approximately 0.02% of residual zinc, approximately 0.04% of residual silicon, 0.19% of residual iron, less than 0.01% of residual manganese, less than 0.002% of residual chromium, less than 0.0006% of residual sodium, other residual elements not exceeding a total of 0.15 or 0.05% for each, and the remainder aluminum. The alloy is prepared from commercially pure molten aluminum having an aluminum content of approximately 99.9% to which scrap is added. The resulting molten aluminum contains residual elements other than aluminum and also elements found in the scrap and an analysis is made to determine the exact composition. Thereafter additions of a master alloy containing 80% aluminum and 20% copper are made to arrive at the copper specification and pig magnesium is added to arrive at the magnesium specification.

The resulting molten aluminum alloy having the above defined composition is continuously cast into strip having a thickness of 0.25 inch and a width of 42 inches on a Hunter caster following prior art continuous casting procedures. The general apparatus and casting techniques employed are disclosed in Hunter U.S. Pat. No. 2,790,216, which is incorporated herein by reference. The strip as cast has an ultimate tensile strength of 18.3 Ksi, a yield strength of 7.6 Ksi, and an elongation of 19%.

The resulting continuously cast strip is cold rolled in the as cast condition following general prior art practice for cold rolling ASM aluminum alloy specification No. 3003 to semirigid container stock gauges. Seven cold rolling passes are used with one intermediate anneal and one final anneal. The initial strip thickness of 0.25 inch is reduced to 0.125 inch, 0.075 inch, and 0.040 inch thicknesses in the first, second and third passes, respectively. The strip is then given an intermediate anneal at 650°F. for 5 hours in an inert atmosphere. The cold rolling sequence is continued thereafter over four passes in which the strip is reduced to 0.020 inch, 0.012 inch, 0.007 inch and 0.004 inch thicknesses, respectively. The resulting semirigid container stock having a final thickness of 0.004 inch and a width of 42 inches is slit and trimmed to produce strip 18 inches wide which is wound on a 3 inch aluminum core, to form two coils having a 20 inch outside diameter. One of the resulting coils is given a final anneal at a temperature of 600°–625°F. for 5 hours in an inert atmosphere to produce fully annealed semirigid container stock (O-temper). The other coil is reserved in the full hard condition (H-18 temper).

The above prepared full hard coil (H-18 temper) has an ultimate tensile strength of 35.5 Ksi, a yield strength of 30.0 Ksi, and an elongation of 2%. The above prepared fully annealed coil (O-temper) has an ultimate tensile strength of 18.0 Ksi, a yield strength of 6.4 Ksi, and an elongation of 25%.

Semirigid container stock of 0.004 inch thickness prepared from ASM aluminum alloy specification No. 3003 has in the fully hard condition (H-18 temper) an ultimate tensile strength of a minimum of 27 Ksi, a yield strength of a minimum of 24 Ksi and an elongation of a minimum of 1%. In the fully annealed condition (O-temper), it has an ultimate tensile strength of 14–19 Ksi, a yield strength of a minimum of 5 Ksi, and an elongation of a minimum of 14%.

From the foregoing data, it may be appreciated that the semirigid container stock of the present invention compares favorably with that produced from ASM aluminum alloy specification 3003.

Semirigid containers are prepared from the container stock produced by this Example employing high speed modern equipment. Blanks are stamped at high speed, and the resulting blanks are shaped in a hydraulic press to the desired configuration of a disposable tray for frozen food. The resulting trays are as satisfactory as those prepared from the prior art ASM aluminum alloy specification 3003.

EXAMPLE II

The general procedure of Example I is repeated with the exception of employing an aluminum alloy containing 0.44% of copper and 0.44% of magnesium. The remaining elements are substantially the same as noted in Example I.

The strip in the as cast condition has an ultimate tensile strength of 18.4 Ksi, a yield strength of 8.2 Ksi, and an elongation of 21%. The semirigid container stock in the full hard condition (H-18 temper) has an ultimate tensile strength of 32.0 Ksi, a yield strength of 32.0 Ksi, and an elongation of 2%. The semirigid container stock in the fully annealed condition has an ultimate tensile strength of 17.5 Ksi, a yield strength of 6.6 Ksi, and an elongation of 21%.

The semirigid container stock is as satisfactory as that prepared in Example I when used for preparing semirigid containers such as food trays.

EXAMPLE III

The general procedure of Example I is repeated with the exception of employing an aluminum alloy containing 0.39% of copper, 0.48% of magnesium and 0.48% of zinc. The remaining elements are substantially the same as noted in Example I. The semirigid container stock thus produced in the fully annealed condition (O-Temper) has an ultimate tensile strength of 14.9–16.1 Ksi and an elongation greater than 27%.

The semirigid container stock is as satisfactory as that prepared in Example I when used for preparing semirigid containers such as food trays.

What is claimed is:

1. An aluminum alloy semirigid container stock prepared from a continuously cast aluminum alloy casting consisting essentially of 0.30–0.50% of copper, 0.35–0.60% of magnesium, up to 0.50% of zinc, residual silicon in an amount up to 0.40%, residual iron in an amount up to 0.70%, residual manganese in an amount up to 0.10%, residual chromium in an amount up to 0.10%, residual sodium in an amount up to 0.0006%, other residual elements in a total amount up to 0.15% and in an amount up to 0.05% for each of the said other residual elements, and the remainder aluminum, the said casting having a thickness not greater than about one inch and being cold rolled in a plurality of cold rolling passes including first and last cold rolling passes to a final thickness of about 0.001–0.01 inch, in the absence of a homogenizing thermal treatment and being subject to at least one anneal at an annealing temperature of 600°–800°F. for a period of 1–6 hours intermediate the said first and last cold rolling passes.

2. An aluminum alloy semirigid container stock prepared by cold rolling a continuously cast aluminum alloy strip consisting essentially of 0.30–0.50% of copper, 0.35–0.60% of magnesium, up to 0.50% of zinc, residual silicon in an amount up to 0.40%, residual iron in an amount up to 0.70%, residual manganese in an amount up to 0.10%, residual chromium in an amount up to 0.10%, residual sodium in an amount up to 0.0006%, other residual elements in a total amount up to 0.15% and in an amount up to 0.05% for each of the said other residual elements, and the remainder aluminum, the said strip having an initial thickness not greater than about one inch and being cold rolled in a plurality of cold rolling passes including first and last cold rolling passes to a final thickness of about 0.001–0.01 inch, the said strip being cold rolled to the final thickness in the absence of a homogenizing thermal treatment and being subject to at least one anneal at an annealing temperature of 600°– 800°F. for a period of 1–6 hours intermediate the said first and last cold rolling passes.

3. The semirigid container stock of claim 2 wherein the residual silicon is present in an amount up to 0.10% and the residual iron is present in an amount up to 0.10%.

4. The semirigid container stock of claim 2 wherein following the last cold rolling pass the said container stock is given a further anneal at a temperature of about 350°–800°F. for about 0.5–10 hours to provide an annealed semirigid container stock product.

5. The semirigid container stock of claim 2 wherein residual zinc is present in an amount up to 0.20%.

6. The semirigid container stock of claim 5 wherein the residual silicon is present in an amount up to 0.10% and the residual iron is present in an amount up to 0.10%.

7. The semirigid container stock of claim 5 wherein following the last cold rolling pass the said container stock is given a further anneal at a temperature of about 350°–800°F. for about 0.5–10 hours to provide an annealed semirigid container stock product.

8. The semirigid container stock of claim 2 wherein the copper is present in an amount of 0.30–0.40%, the magnesium is present in an amount of 0.40–0.55%, and the zinc is present in an amount of 0.30–0.50%.

9. The semirigid container stock of claim 8 wherein the residual silicon is present in an amount up to 0.10% and the residual iron is present in an amount up to 0.10%.

10. The semirigid container stock of claim 8 wherein following the last cold rolling pass the said container stock is given a further anneal at a temperature of about 350°–800°F. for about 0.5–10 hours to provide an annealed semirigid container stock product.

11. The semirigid container stock of claim 2 wherein the continuously cast aluminum alloy strip has an initial thickness of about 0.2–0.3 inch and the said strip is cold rolled to a thickness of about 0.002–0.008 inch and is subjected to only one anneal intermediate the said first and last cold rolling passes.

12. The semirigid container stock of claim 11 wherein following the last cold rolling pass the said container stock is given a further anneal at a temperature of about 350°–800°F. for about 0.5–10 hours to provide an annealed semirigid container stock product.

13. The semirigid container stock of claim 11 wherein residual zinc is present in an amount up to 0.20%.

14. The semirigid container stock of claim 13 wherein following the last cold rolling pass the said container stock is given a further anneal at a temperature of about 350°–800°F. for about 0.5–10 hours to provide an annealed semirigid container stock product.

15. The semirigid container stock of claim 11 wherein the copper is present in an amount of 0.30–0.40%, the magnesium is present in an amount of 0.40–0.55%, and the zinc is present in an amount of 0.30–0.50%.

16. The semirigid container stock of claim 15 wherein following the last cold rolling pass the said container stock is given a further anneal at a temperature of about 350°–800°F. for about 0.5–10 hours to provide an annealed semirigid container stock product.

17. A method of preparing an aluminum alloy semirigid container stock comprising the steps of continuously casting an aluminum alloy casting consisting essentially of 0.30–0.50% of copper, 0.35–0.60% of magnesium, up to 0.50% of zinc, residual silicon in an amount up to 0.40%, residual iron in an amount up to 0.70%, residual manganese in an amount up to 0.10%, residual chromium in an amount up to 0.10%, residual sodium in an amount up to 0.0006%, other residual elements in a total amount up to 0.15% and in an amount up to 0.05% for each of said other residual elements and the remainder aluminum, cold rolling the said continuously cast aluminum alloy casting in strip form having a thickness not greater than about one inch in a plurality of cold rolling passes including first and last cold rolling passes and in the absence of a homogenizing thermal treatment to a final thickness of about 0.001–0.01 inch, and annealing the said strip at least once intermediate the said first and last cold rolling passes at an annealing temperature of 600°–800°F. for a period of 1–6 hours.

18. A method of preparing an aluminum alloy semirigid container stock comprising the steps of continuously casting an aluminum alloy strip having an initial thickness not greater than about 1 inch consisting essentially of 0.30–0.50% of copper, 0.35–0.60% of magnesium, up to 0.50% of zinc, residual silicon in an amount up to 0.40%, residual iron in an amount up to 0.70%, residual manganese in an amount up to 0.10%, residual chromium in an amount up to 0.10%, residual sodium in an amount up to 0.0006%, other residual elements in a total amount up to 0.15% and in an amount up to 0.05% for each of said other residual elements and the remainder aluminum, cold rolling the said continuously cast aluminum alloy strip in a plurality of cold rolling passes including first and last cold rolling passes and in the absence of a homogenizing thermal treatment to a final thickness of about 0.001–0.01 inch, and annealing the said strip at least once intermediate the said first and last cold rolling passes at an annealing temperature of 600°–800°F. for a period of 1–6 hours.

19. The method of claim 18 wherein the residual silicon is present in an amount up to 0.10% and the residual iron is present in an amount up to 0.10%.

20. The method of claim 18 wherein following the last cold rolling pass the said container stock is given a further anneal at a temperature of about 350°–800°F. for about 0.5–10 hours to provide an annealed semirigid container stock product.

21. The method of claim 18 wherein residual zinc is present in an amount up to 0.20%.

22. The method of claim 21 wherein the residual silicon is present in an amount up to 0.10% and the residual iron is present in an amount up to 0.10%.

23. The method of claim 21 wherein following the last cold rolling pass the said container stock is given a further anneal at a temperature of about 350°–800°F. for about 0.5–10 hours to provide an annealed semirigid container stock product.

24. The method of claim 18 wherein the copper is present in an amount of 0.30–0.40%, the magnesium is present in an amount of 0.40–0.55%, and the zinc is present in an amount of 0.30–0.50%.

25. The method of claim 24 wherein the residual silicon is present in an amount up to 0.10% and the residual iron is present in an amount up to 0.10%.

26. The method of claim 24 wherein following the last cold rolling pass the said container stock is given a further anneal at a temperature of about 350°–800°F. for about 0.5–10 hours to provide an annealed semirigid container stock product.

27. The method of claim 18 wherein the continuously cast aluminum alloy strip has an initial thickness of about 0.2–0.3 inch and the said strip is cold rolled to a thickness of about 0.002–0.008 inch and is subjected to only one anneal intermediate the said first and last cold rolling passes.

28. The method of claim 27 wherein following the last cold rolling pass the said container stock is given a further anneal at a temperature of about 350°–800°F. for about 0.5–10 hours to provide an annealed semirigid container stock product.

29. The method of claim 27 wherein residual zinc is present in an amount up to 0.20%.

30. The method of claim 29 wherein following the last cold rolling pass the said container stock is given a further anneal at a temperature of about 350°–800°F. for about 0.5–10 hours to provide an annealed semirigid container stock product.

31. The method of claim 27 wherein the aluminum alloy strip contains about 0.001–0.01% of at least one substance selected from the group consisting of boron and titanium as a grain refining agent.

32. The method of claim 27 wherein the copper is present in an amount of 0.30–0.40%, the magnesium is present in an amount of 0.40–0.55%, and the zinc is present in an amount of 0.30–0.50%.

33. The method of claim 31 wherein following the last cold rolling pass the said container stock is given a further anneal at a temperature of about 350°–800°F. for about 0.5–10 hours to provide an annealed semirigid container stock product.

34. The method of claim 32 wherein the aluminum alloy strip contains about 0.001–0.01% of at least one substance selected from the group consisting of boron and titanium as a grain refining agent.

* * * * *